US005202081A

United States Patent [19]

Lake et al.

[11] Patent Number: 5,202,081

[45] Date of Patent: Apr. 13, 1993

[54] LAUNDER SYSTEM FOR SUPPLYING MOLTEN METAL AND A LAUNDER NOZZLE

[75] Inventors: Paul W. Lake, Yorkshire; Gordon J. S. Higginbotham, Derby, both of England

[73] Assignee: Rolls-Royce plc, London, England

[21] Appl. No.: 869,848

[22] Filed: Apr. 16, 1992

Related U.S. Application Data

[63] Continuation of Ser. No. 672,676, Mar. 20, 1991, abandoned.

[30] Foreign Application Priority Data

Apr. 17, 1990 [GB] United Kingdom ..... 9008538

[51] Int. Cl.[5] ..... B22D 35/04

[52] U.S. Cl. ..... 266/231; 222/591

[58] Field of Search ..... 266/227, 230, 231, 236, 266/238; 222/591, 593; 164/358, 337, 134

[56] References Cited

U.S. PATENT DOCUMENTS

| | | | |
|---|---|---|---|
| 2,757,425 | 4/1956 | Duncan et al. | 164/358 |
| 3,604,598 | 9/1971 | Kappmeyer et al. | 222/593 |
| 4,475,721 | 10/1984 | Pamart | 266/236 |
| 4,601,460 | 7/1986 | Tyler et al. | 266/227 |
| 4,708,326 | 11/1987 | Brockmeyer et al. | 266/227 |
| 4,802,527 | 2/1989 | Brockmeyer | 164/358 |
| 4,909,836 | 3/1990 | El-Kaddah | 266/230 |
| 4,913,218 | 4/1990 | Seidinger | 164/358 |

FOREIGN PATENT DOCUMENTS

| | | |
|---|---|---|
| 0234572 | 9/1987 | European Pat. Off. . |
| 0865942 | 5/1952 | Fed. Rep. of Germany . |
| 2068096 | 8/1981 | United Kingdom . |

*Primary Examiner*—Scott Kastler

*Attorney, Agent, or Firm*—Cushman, Darby & Cushman

[57] ABSTRACT

A launder system for supplying molten metal from a crucible to a casting mould or a secondary process has a nozzle with a filter positioned therein to filter the molten metal as it flows through the nozzle. The nozzle and filter assembly is removably attachable to the launder system, and is used once and then replaced by a new nozzle and filter assembly. Efficient cleaning of the molten metal thus occurs without an increase in blockage due to the filter. Additionally, the scrapping rate of the launder system is reduced, allowing multiple usage of the launder.

14 Claims, 3 Drawing Sheets

LAUNDER SYSTEM FOR SUPPLYING MOLTEN METAL AND A LAUNDER NOZZLE

This is a continuation of application Ser. No. 07/672,676, filed on Mar. 20, 1991, which was abandoned.

BACKGROUND OF THE INVENTION

1. Field of the Invention

The present invention relates to launder systems for supplying molten metal from a source of molten metal to a casting mould or a secondary process, and is particularly concerned with the launder nozzle.

2. Description of Related Art

It is current practice to melt a metal in a crucible and to supply the molten metal from the crucible to one or more casting moulds or to a secondary process. The molten metal is supplied along launders which have one or more channels to interconnect the crucible and the casting moulds or secondary process.

It is known to incorporate devices to remove or reduce the amount of inclusions present in the molten metal passing along the launder, so as to clean the molten metal and thereby improve the integrity of finished cast articles.

One way of achieving this is to provide one or more dams or weirs in the launder to trap the inclusions. However, some inclusions can still be carried through to the casting mould or secondary process.

Another way of achieving this is to provide a fixed filter in the launder. This is more efficient at cleaning the molten metal than the dams. However, the provision of the filter in the launder increases the possibility of blockages occurring which can result in the scrapping and remaking of the launder.

In some launders a ceramic lining is cemented into the launder, and is normally replaced after each casting operation.

In some crucibles a ceramic lining is provided, and it is usual practice with such crucibles to have a wash out melt which cleans the surface of the ceramic lining and removes any loose debris. Thus it can be seen that presently used launders are used only once and are wasteful of their ceramic linings.

SUMMARY OF THE INVENTION

The present invention seeks to provide a launder system in which the launder may be used more than once to gain benefit from their ceramic linings and to incorporate a filter.

Accordingly the present invention provides a launder system for supplying molten metal from a source of molten metal to a casting mould or a secondary process comprising a nozzle arranged, in operation, to supply the molten metal from the launder to the casting mould or the secondary process, and a filter arranged within the nozzle to filter the molten metal as it flows through the nozzle, the nozzle and filter assembly being removably attached to the launder.

A changing means may be arranged to remove a first used nozzle and filter assembly from the launder and to install a second unused nozzle and filter assembly into the launder.

Preferably the filter is a reticulated foam filter.

The launder and nozzle have mating faces, and the mating faces may have sealing means to prevent the leakage of molten metal.

The sealing means may comprise interengaging grooves and lands on the mating faces.

The sealing means may comprise a refractory wadding on either of the mating surfaces.

The launder may have a ceramic lined channel.

The filter may be integral with the nozzle.

Heating means may be provided to heat the nozzle and filter assembly. Preferably the heating means comprises an at least one electrical induction coil. Preferably an electrically conducting ring is located within the electrical induction coil, and is arranged around the nozzle.

The present invention also provides a launder nozzle comprising a filter arranged such that in use it filters molten metal as it flows through the nozzle.

Preferably the filter is a reticulated foam filter.

The filter may be integral with the nozzle.

BRIEF DESCRIPTION OF THE DRAWINGS

The present invention will be more fully described by way of example with reference to the accompanying drawings, in which.

DETAILED DESCRIPTION OF THE PREFERRED EMBODIMENTS

Figure 1:
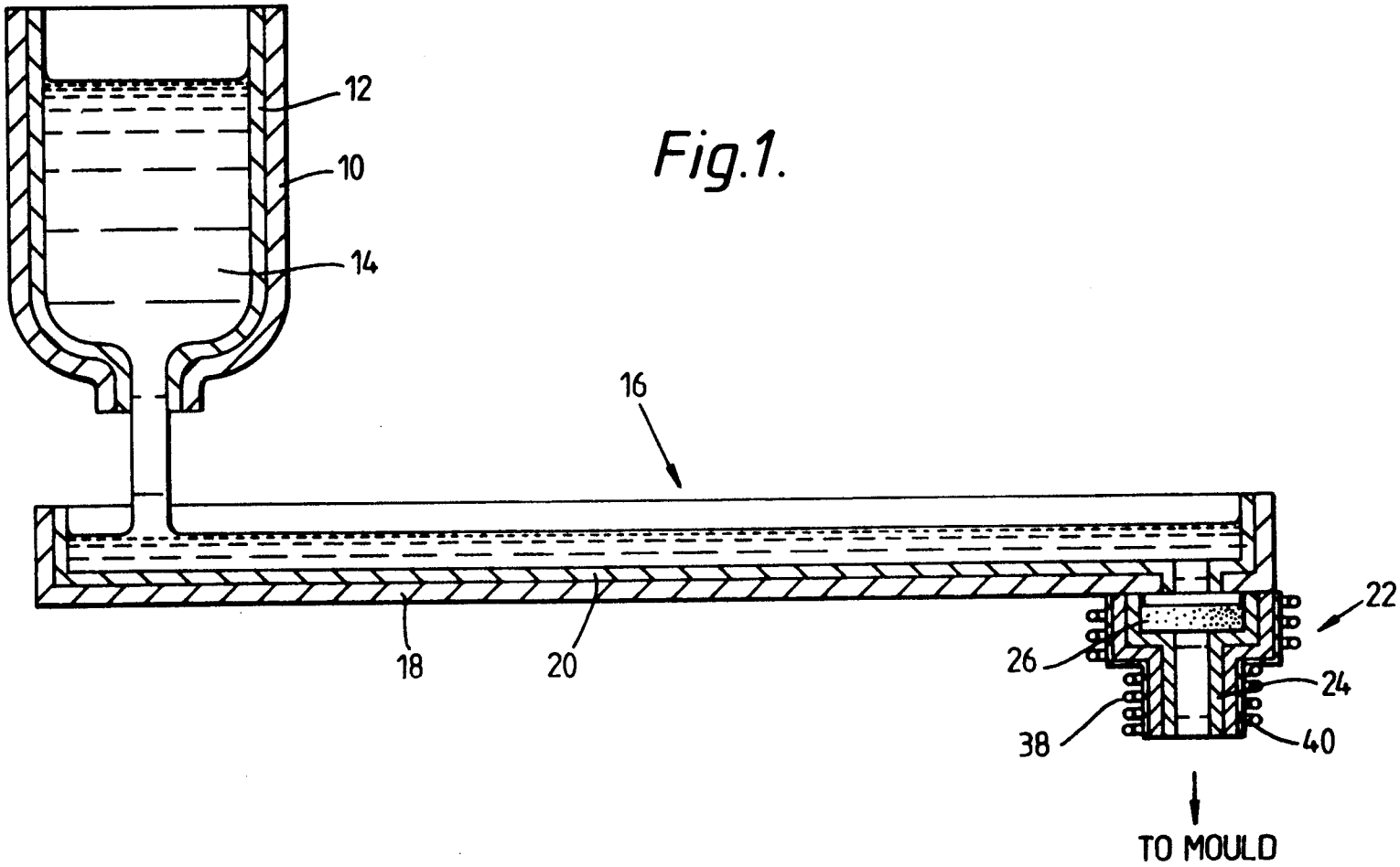
FIG. 1 is a longitudinal cross-sectional view through a crucible for molten metal and a launder system according to the present invention.

In FIG. 1 a crucible 10 contains molten metal 14. The crucible 10 has a lining 12 of ceramic material. The crucible 10 is arranged to supply the molten metal 14 to one or more casting moulds or a secondary process via a launder system 16. The secondary process may be an atomisation process for coating articles or depositing the atomised particles on a former to create an article or to create metallic powder.

The launder system 16 comprises one or more channel members 18 which have linings 20 of ceramic material. The launder system 16 also comprises one or more nozzles 22 which supply the molten metal from the launder channel members 18 to the casting moulds or secondary process.

Each nozzle 22 has a ceramic lining 24 and is provided with a filter 26 which is positioned within the nozzle 22. The filter 26 is arranged to filter the molten metal as it flows through the nozzle 22 from the launder channel members 18 to the casting mould or secondary process.

The nozzle 22 and filter 26 assembly is removably attachable to the launder channel member 18 by suitable means, so that after the nozzle and filter assembly has been used it can be replaced by a new nozzle and filter assembly.

The provision of the removable nozzle and filter assembly allows efficient cleaning of the molten metal without the disadvantage of an increased possibility of blockage. This reduces the scrapping rate and hence allows the launder assembly to be used many times to gain maximum benefit from the ceramic lining.

An electrical induction heating coil 38 is located coaxially around the nozzle 22 and filter 26 assembly, to directly heat the molten metal as it flows through the nozzle 22 and filter 26 assembly reducing the possibility of the metal solidifying in the nozzle 22 or filter 26. It may be desirable to use several induction heating coils positioned coaxially around the nozzle and filter assembly, especially induction coils of different diameters to correspond with portions of the nozzle 22 having different outer diameters. An electrically conducting ring 40, a susceptor, is located coaxially within the induction heating coil 38, and coaxially around the nozzle 22 and filter 26 assembly. The electrically conducting ring 40 is heated by the electrical induction coil 38, and then the electrically conducting ring 40 radiates heat to heat the nozzle 22 ad filter 26 assembly. The induction coil used together with the susceptor may be used to preheat the nozzle and filter assembly, before molten metal flows therethrough, whereas the induction coil alone cannot preheat the nozzle and filter assembly. The electrically conducting ring 40 in this example is a graphite ring. The electrically conducting ring 40 contacts the nozzle 22 in FIG. 1, however the ring 40 may be spaced from the nozzle 22.

Although an electrical induction heating coil has been shown in the figure, a radiant heater, for example an electrical resistance heater, may be used to heat the nozzle and filter assembly. Radiant heaters may also be used to preheat the nozzle and filter assembly before molten metal flows therethrough, to prevent or reduce the possibility of the molten metal solidifying in the nozzle and filter assembly.

The nozzle 22 is manufactured using appropriate ceramic moulding technology, for example isostatic pressing or injection moulding followed by sintering. Other suitable methods may be used, for example shell moulding. The filter 26 is a reticulated foam filter but other suitable filters may be used.

A mechanism to allow quick changing of the nozzle and filter assemblies may be provided to remove a used nozzle and filter assembly and to install a new unused nozzle and filter assembly.

Figure 4:
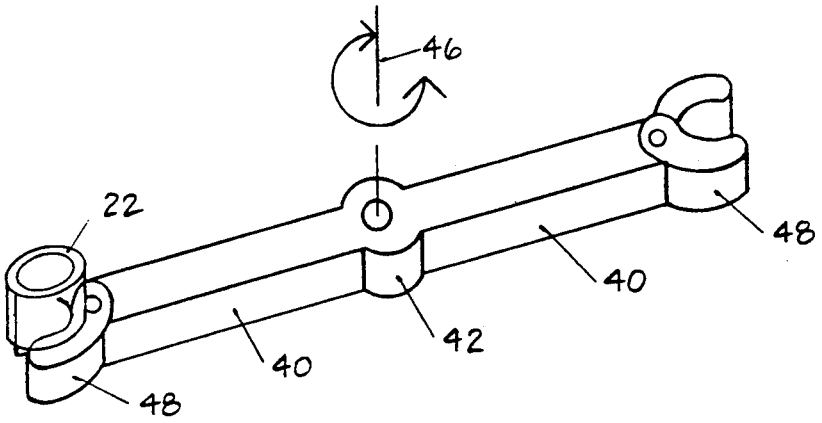

The quick change mechanism, as shown in FIG. 4 for example, may comprise an arm 40 which has first and second ends. The arm is pivotally mounted at its first end about a vertical axis 46, and the second end 48 is arranged to releasably hold the nozzle 22 and filter 26 assembly. The arm 40 is simply rotated about its pivotal axis 46 between a first position and a second position. In the first position a new unused nozzle 22 and filter 26 assembly is located in the second end 48 of the arm 40, the arm is then rotated to the second position to position the new nozzle and filter assembly underneath the launder for use. The arm 40 is then rotated back to the first position, to allow the used nozzle and filter assembly to be removed and, to allow a further new nozzle and filter assembly to be used.

The quick change mechanism could equally well comprise a number of arms 40 pivotally mounted at their first ends 42 about the same vertical axis 46, each of the arms 40 having a second end to releasably hold a nozzle 22 and filter 26 assembly.

The quick change mechanism could alternately comprise a reciprocatory arm.

Figure 2:
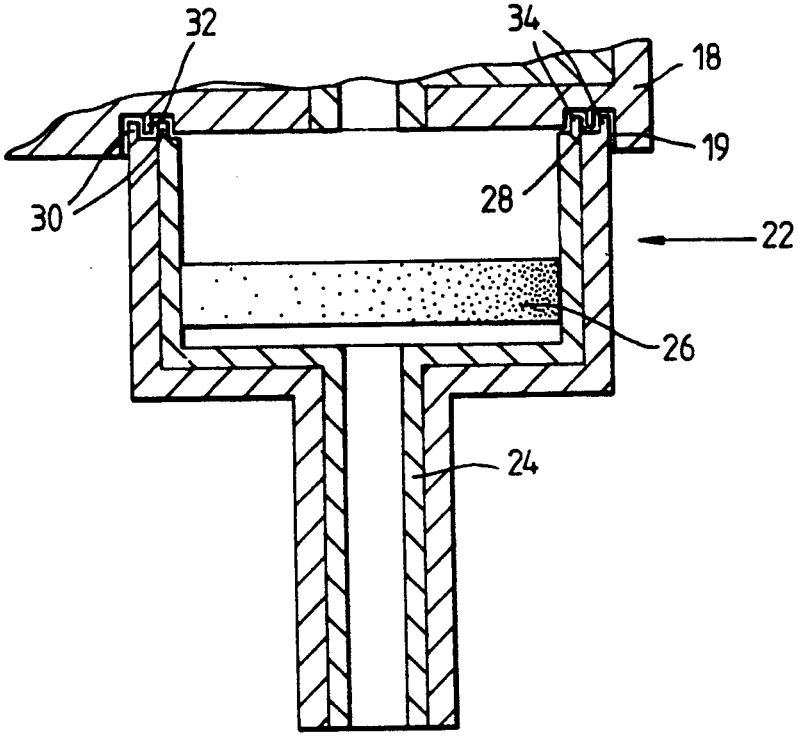
FIG. 2 is an enlarged cross-sectional view through a portion of the launder system shown in FIG. 1.

A portion of the launder channel member 18 and the nozzle 22 is shown in FIG. 2, the mating face of the launder channel member 18 has lands 32 and grooves 34 which interengage with grooves 28 and lands 30 respectively on the mating face of the nozzle 22 to form a seal.

The upper end of the nozzle 22 fits into a recess 19 on the underside of the launder 18. The nozzle 22 is pushed into the recess 19 to be located with respect to the launder 18, and is pulled out of the recess 19 for removal. In use the nozzle 22 is held stationary by the clamping action between the launder 18 and the arm of the changing mechanism.

Figure 3:
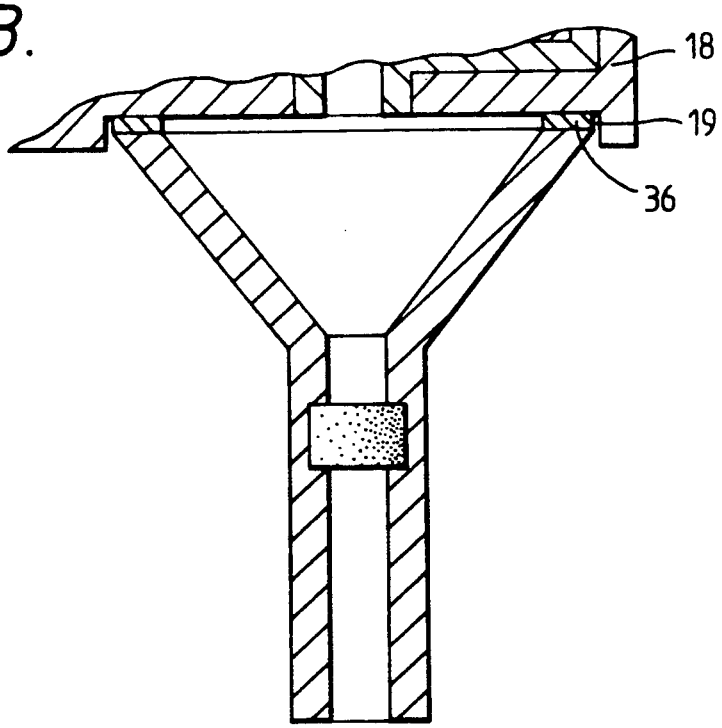
FIG. 3 is an enlarged cross-sectional view of an alternative embodiment of the portion of the launder system shown in FIG. 1.

An alternative seal is shown in FIG. 3, in which a refractory wadding 36 is positioned between the mating surfaces of the launder channel member 18 and the nozzle 22.

Alternative positions for the filter 26 are also shown in FIGS. 2 and 3, and the nozzle 2 in FIG. 3 is wholly ceramic and has a smooth conical shape to reduce the possibility of cracking by thermal shocks.

Although the filter is a separate element from the nozzle as shown in the Figures, it may alternatively be formed integrally with the nozzle.

We claim:

1. A continuous launder system for supplying molten metal from a source of molten metal to at least one casting mould or a secondary process, comprising:

at least one channel member having an inlet and an outlet for conveying said molten metal from said inlet to said outlet without any interruptions between said inlet and said outlet, and at least one nozzle attached to said outlet of the at least one channel member to supply the molten metal from said outlet of the at least one channel member to the at least one casting mould or secondary process, each of the at least one nozzle having a through-bore located therein with a filter disposed therein across said through-bore to define an assembly to filter molten metal as it flows through the nozzle, said nozzle and filter assembly being removably attached to the at least one channel member.

2. A launder system as claimed in claim 1 in which heating means are provided to heat the nozzle and filter assembly.

3. A launder system as claimed in claim 2 in which the heating means comprises at least one electrical induction heating coil.

4. A launder system as claimed in claim 3 in which an electrically conducting ring is located within the electrical induction coil, and is arranged around the nozzle.

5. A launder system as claimed in claim 2 in which the heating means comprises at least one electrical resistance heater.

6. A launder system as claimed in claim 1 in which a changing means is arranged to remove a first used nozzle and filter assembly from the launder and to install a second unused nozzle and filter assembly into the launder.

7. A launder system as claimed in claim 6 in which the changing means comprises an arm which has a first end and a second end, the arm is pivotally mounted at its first end about an axis, the second end is arranged to releasably hold a nozzle and filter assembly, the arm is rotated to remove a first used nozzle and filter assembly from the launder or is rotated to install a second unused nozzle and filter assembly into the launder.

8. A launder system as claimed in claim 6 in which the changing means comprises a plurality of arms, each arm has a first end and a second end, the arms are pivotally mounted at their first ends about a common axis, the second ends are arranged to releasably hold a nozzle and filter assembly, the arms are rotated such that one of the arms removes a first used nozzle and filter assembly from the launder and another one of the arms installs a second unused nozzle and filter assembly into the launder.

9. A launder system as claimed in claim 1 in which the filter is a reticulated foam filter.

10. A launder system as claimed in claim 1 in which the launder and nozzle have mating faces, the mating faces having sealing means to prevent the leakage of molten metal.

11. A launder system as claimed in claim 10 in which the sealing means comprises interengaging grooves and lands on the mating faces.

12. A launder system as claimed in claim 10 in which the sealing means comprises a refractory wadding on either of the mating surfaces.

13. A launder system as claimed in claim 1 in which the launder has a ceramic lined channel.

14. A launder system as claimed in claim 1 in which the filter is integral with the nozzle.

* * * * *